US008490308B2

(12) United States Patent
Schneider

(10) Patent No.: US 8,490,308 B2
(45) Date of Patent: Jul. 23, 2013

(54) SMALL CALIBER MUZZLE LOADING BLACKPOWDER FIREARM ADAPTED TO FIRE A SKIRTED PROJECTILE AND METHOD OF INSERTING SUCH A PROJECTILE IN THE BORE OF SUCH A FIREARM

(76) Inventor: John J. Schneider, Cape Girardeau, MO (US)

( * ) Notice: Subject to any disclaimer, the term of this patent is extended or adjusted under 35 U.S.C. 154(b) by 13 days.

(21) Appl. No.: 12/879,125

(22) Filed: Sep. 10, 2010

(65) Prior Publication Data

US 2011/0061279 A1 Mar. 17, 2011

Related U.S. Application Data

(60) Provisional application No. 61/241,532, filed on Sep. 11, 2009.

(51) Int. Cl.
*F41C 9/08* (2006.01)

(52) U.S. Cl.
USPC ..... 42/51; 42/76.01

(58) Field of Classification Search
USPC ..... 42/51, 76.01
See application file for complete search history.

(56) References Cited

U.S. PATENT DOCUMENTS

| | | | | |
|---|---|---|---|---|
| 1,565 | A * | 4/1840 | Clark | 42/51 |
| 5,782,030 | A * | 7/1998 | French | 42/76.01 |
| 6,796,068 | B2 * | 9/2004 | Crowson et al. | 42/51 |

* cited by examiner

*Primary Examiner* — Daniel J Troy
(74) *Attorney, Agent, or Firm* — Polster Lieder Woodruff & Lucchesi, L.C.

(57) ABSTRACT

A muzzle loading blackpowder firearm is disclosed having a barrel with a standard caliber bore therein. The firearm is adapted to fire a projectile having a skirted aft end of a larger initial diameter than the standard caliber bore of the firearm. The barrel has an enlarged bore at its outer end sized to receive the projectile aft end first, and a tapered transition between the enlarged bore and the standard caliber bore so that upon forcing the projectile through the enlarged bore and through the tapered transition, the tapered transition reduces the skirted aft end to the diameter of the standard bore.

1 Claim, 1 Drawing Sheet

SMALL CALIBER MUZZLE LOADING BLACKPOWDER FIREARM ADAPTED TO FIRE A SKIRTED PROJECTILE AND METHOD OF INSERTING SUCH A PROJECTILE IN THE BORE OF SUCH A FIREARM

CROSS-REFERENCE TO RELATED APPLICATIONS

This application relates to and claims priority to U.S. Provisional Patent Application No. 61/241,532, filed on Sep. 11, 2009, and incorporates this provisional application by reference in its entirety.

PRIORITY INFORMATION

STATEMENT REGARDING FEDERALLY SPONSORED RESEARCH OR DEVELOPMENT

Not Applicable.

BACKGROUND OF THE DISCLOSURE

The present disclosure relates to muzzle loading blackpowder firearms adapted to fire a skirted projectile, such as air rifle pellet. Typically, a muzzle loading blackpowder firearm utilizes a relatively heavy projectile having a relatively large bore barrel. This in turn requires that a substantial amount of blackpowder be loaded in the barrel via the muzzle. Then, a projectile having essentially the same diameter as the bore of the barrel is forced down the barrel so that it contacts the blackpowder. Upon the shooter pulling the trigger of the firearm, the blackpowder charge is ignited and the expanding gas within the confined barrel forces the projectile from the barrel.

While this system has worked well for several centuries, for target practice and for younger shooters, because these large bore blackpowder firearms used large (heavy) projectiles and large blackpowder charges, it was relatively expensive (as compared, for example to .22 caliber rim fired cartridges), and has strong recoil. Thus, there has been a longstanding need for a blackpowder, muzzle loading, small caliber firearm and system that used readily available projectiles, was easy to load, required no special tools to load the projectile in the barrel, exhibited little recoil, and was inexpensive to use.

SUMMARY OF THE DISCLOSURE

A muzzle loading blackpowder firearm is disclosed having a barrel with a standard caliber bore therein. The firearm is adapted to fire a projectile having a skirted aft end of a larger initial diameter than the standard caliber bore of the firearm. The barrel has an enlarged bore at its outer end sized to receive the projectile aft end first, and a tapered transition between the enlarged bore and the standard caliber bore so that upon forcing the projectile down the enlarged bore and through the tapered transition, the tapered transition reduces the skirted aft end to the diameter of the standard bore.

BRIEF DESCRIPTION OF THE DRAWINGS

Corresponding reference characters indicated corresponding parts throughout the several views of the drawings.

DESCRIPTION OF A PREFERRED EMBODIMENT

Figure 1:
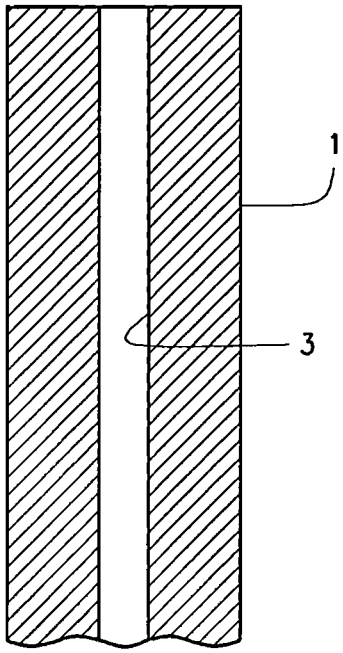
FIG. 1 PRIOR ART
FIG. 1 is a cross sectional view of the muzzle of a conventional muzzle loading blackpowder firearm illustrating that the rifle bore has a constant diameter along its length.

Referring now to the drawings, FIG. 1 illustrates the muzzle end of a barrel 1 of a muzzle loading blackpowder firearm. For purposes of this disclosure, the firearm may be either a rifle or a handgun. Except for the modified muzzle end of the barrel, as will herein explained in greater detail, the firearm is conventional and thus will not be described herein as its structure and operation is well known to those of ordinary skill in the art. As can be seen in FIG. 1, the barrel 1 has a small caliber bore (e.g., a .22 caliber bore) 3 extending lengthwise therethrough. As is conventional, the bore 3 has a constant diameter along its length and may be provided with spiral riflings or grooves (not shown).

In use, such conventional muzzle loading blackpowder firearms are loaded by first introducing a charge of a predetermined amount of blackpowder into the muzzle end of the barrel and then inserting an appropriately sized projectile into the bore. The projectile may either be a ball or a pointed projectile. The ball, of course, has a diameter sized to fit closely within the bore 3 of the barrel. If a pointed projectile is used, the projectile has a pointed outer end, a generally cylindric body, and a blunt inner end with the diameter of the cylindric body being sized to fit closely within the bore. After the blackpowder charge has been loaded in the barrel, the projectile is inserted in the muzzle of the barrel blunt end first, and is forced down the bore with a ram rod or the like until the projectile somewhat compacts the blackpowder charge within the barrel. Then, upon ignition of the blackpowder charge, the projectile is forced out of the barrel at a relatively high velocity.

The system and method of this disclosure, instead of using a relatively large caliber projectile, is especially well-suited for use with smaller caliber projectiles (e.g., .177 or .22 caliber projectiles). However, within the broader aspects of this disclosure, those of ordinary skill in the art that the system herein disclosed would be usable with other caliber projectiles larger or smaller than the above-noted .22 or .177 caliber projectiles.

Figure 4:
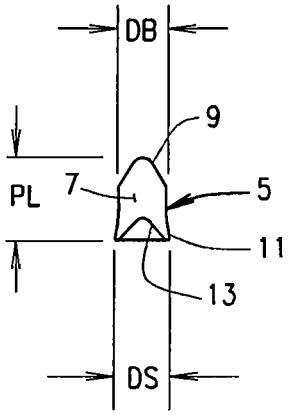
FIG. 4 is a side elevational view of a commercially available skirted projectile or air rifle pellet used with the system of this disclosure.

Referring now to FIG. 4, a conventional air rifle pellet is shown. This particular pellet is a .22 caliber air rifle pellet, which is indicated in its entirety at 5, commercially available from Beeman under the tradename Kodiak. While the particular pellet shown in FIG. 4 is a .22 caliber projectile, it will be understood that other calibers may be used equally as well in other systems utilizing the principles herein disclosed. The projectile 5 has a body 7 with a pointed head 9 and a flared aft end or skirt 11 that is somewhat larger than the body 7. The diameter of the body 7 may, for example, be about 0.2160 inches, while the diameter of the aft end or skirt 11 may be about 0.2240 inches. In FIG. 4, the diameter of the body is indicated by DB and the diameter of skirt 11 is indicated by DS. The projectile 5 has a projectile length PL of about 0.350 inches. The flared aft end 11 of the pellet has a cone-shaped recess 13 within the skirt so that the skirt is hollow. It will be appreciated that the diameter of a standard .22 caliber barrel bore is about 0.2170 inches. Thus, the diameter DB of the body is just slightly smaller than bore 3; while the diameter of the aft end DS is about 0.007 inches larger than bore 3. Thus, it will appreciate that the pellet 5 cannot normally be inserted aft end first into a .22 caliber bore 3.

Figure 2:
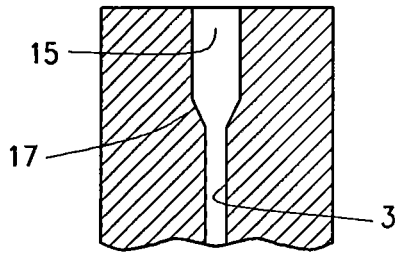
FIG. 2 is a view of the muzzle end of the barrel shown in FIG. 1 which has been modified in accordance with the present disclosure to have an enlarged diameter end portion, a tapered transition, and small caliber bore for the remainder of the length of the barrel, this enlarged end portion permitting a projectile having a skirt of larger diameter than the small caliber bore to be inserted therein aft end first, the tapered transition reducing the diameter of the skirt as the projectile being forced down the tapered transition and allows the projectile to be forced down the remainder of the bore thus permitting a commercially available air rifle pellet to be fired in this firearm.
Figure 3:
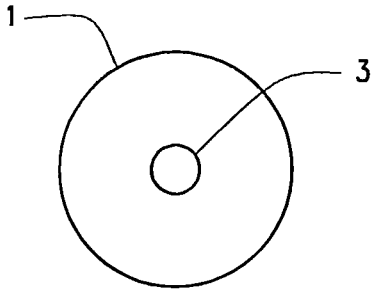
FIG. 3 PRIOR ART
FIG. 3 is an end view of the barrel shown in FIG. 1.

Referring FIG. 2, and in accordance with this disclosure, a modification of the muzzle end of a barrel 1 is shown so that the above described pellet or projectile 5 may be inserted aft end first into a bore 3. Specifically, barrel 1 has been modified to have an enlarged bore 15 at the muzzle end of the barrel. For example, this enlarged bore 15 may have a diameter of about 0.2280 inches, which is about 0.001 inches larger than the diameter DS of the flared aft end of projectile 5. This enlarged bore 15 thus allows the projectile 5 to be inserted in the bore aft end first. Inwardly of the enlarged bore 15 is a tapered transition, as indicated at 17, which narrows the diameter of the enlarged bore to the standard caliber bore 3 of the barrel. This taper 17 is preferably, but not necessarily, tapered at a taper angle of about a 2° to about a 3° between the enlarged bore 15 and the standard caliber bore 3. The angle of the taper is not critical, but the above-described taper has been found to work well.

In use, after the blackpowder charge has been introduced into bore 3, a pellet 5 is installed aft end first in the enlarged bore 15. A conventional ram rod (not shown) is used to force the pellet down the barrel. As the skirt 11 encounters the taper 17, the skirt is compressed so as to reduce its diameter in a uniform manner. It will be appreciated that because pellet 5 is typically made of lead or other soft metal, the hollow skirt 11 can be readily compressed by taper 17. Of course, the hollow skirt helps to insure that the skirt readily and uniformly compressed. Further, the taper insures that the compressed diameter of the skirt has a close fit with bore 3. This in turn provides a tight gas seal with the bore when the blackpowder charge is ignited. In turn, this maximizes the muzzle velocity of the pellet as it exits the bore 3 upon firing of the firearm.

Those skilled in the art will recognize that the cost is such commercially available air rifle pellets 5 is quite low in relation to heavier caliber projectiles typically used with muzzle loading blackpowder firearms. Further, the amount of powder needed to fire such a small caliber firearm is much less than with larger caliber firearms. Still further, because the powder charge is smaller and because the weight of pellet 5 is much less, the recoil of such a small caliber blackpowder firearm is much less such that young shooters are better able to shoot multiple rounds without being subjected to severe recoil.

As various changes could be made in the above constructions without departing from the broad scope of the invention, it is intended that all matter contained in the above description or shown in the accompanying drawings shall be interpreted as illustrative and not in a limiting sense.

The invention claimed is:

1. A method of enabling a muzzle loading blackpowder firearm to fire a projectile having a flared aft end of an initially larger diameter than the predetermined caliber bore diameter of said firearm, said firearm having a barrel with said predetermined caliber bore therein, said barrel having an enlarged bore at its outer end and a tapered transition between said enlarged bore and said predetermined caliber bore, said method comprising the steps of inserting the aft end of said projectile aft end first in said enlarged bore, forcing said projectile through said enlarged bore and through said taper thereby to reduce said aft end of said projectile to the diameter of said predetermined caliber bore, and then continuing to force the projectile down the predetermined caliber bore.

* * * * *